US007727042B2

(12) United States Patent
Park

(10) Patent No.: US 7,727,042 B2
(45) Date of Patent: Jun. 1, 2010

(54) FLUORESCENT LAMP AND MANUFACTURING METHOD THEREOF

(75) Inventor: Yong-Seok Park, Seoul (KR)

(73) Assignee: DMS Co., Ltd., Kyungki-do (KR)

( * ) Notice: Subject to any disclaimer, the term of this patent is extended or adjusted under 35 U.S.C. 154(b) by 479 days.

(21) Appl. No.: 11/607,687

(22) Filed: Dec. 1, 2006

(65) Prior Publication Data

US 2007/0161318 A1 Jul. 12, 2007

(30) Foreign Application Priority Data

Dec. 26, 2005 (KR) ..... 10-2005-0129678

(51) Int. Cl.
*H01J 9/00* (2006.01)

(52) U.S. Cl. ..... 445/26

(58) Field of Classification Search ..... 445/9, 445/11, 14, 23–26, 29, 35, 46, 52, 58; 313/627–643, 313/567; 427/63–73
See application file for complete search history.

(56) References Cited

U.S. PATENT DOCUMENTS

| | | | | |
|---|---|---|---|---|
| 5,646,483 | A * | 7/1997 | Myojo et al. | 313/595 |
| 2003/0020407 | A1 | 1/2003 | Arnold et al. | 313/635 |
| 2006/0076895 | A1* | 4/2006 | Wada et al. | 313/635 |
| 2006/0214555 | A1* | 9/2006 | Kim et al. | 313/491 |
| 2008/0012498 | A1* | 1/2008 | Takata | 313/607 |
| 2008/0290788 | A1* | 11/2008 | Nagara et al. | 313/504 |

FOREIGN PATENT DOCUMENTS

| | | | |
|---|---|---|---|
| CN | 1236182 | A | 11/1999 |
| EP | 1 340 243 | B1 | 9/2003 |
| JP | 07-230788 | A | 8/1955 |
| JP | 04-262363 | A | 9/1992 |
| JP | 09-092218 | A | 4/1997 |
| JP | 11-167901 | A | 6/1999 |
| JP | 2000-100384 | * | 7/2000 |
| JP | 2000-285802 | A | 10/2000 |
| JP | 2003-036811 | A | 2/2003 |
| JP | 2003-091007 | A | 3/2003 |
| KR | 10-1999-0083535 | A | 11/1999 |
| KR | 1020010074017 | A | 4/2001 |
| TW | 525208 | B | 3/2003 |
| TW | 554368 | B | 9/2003 |
| WO | 2004/049375 | A1 | 6/2004 |

* cited by examiner

*Primary Examiner*—Joseph L Williams
*Assistant Examiner*—Brenitra M Lee
(74) *Attorney, Agent, or Firm*—Ladas & Parry, LLP

(57) ABSTRACT

A method of manufacturing a fluorescent lamp is provided. One of a dispersed metal oxide precursor sol prepared by a sol-gel reaction and a fluorescent substance slurry is coated on a glass tube having at least one open side and then the other of the fluorescent substance slurry and the dispersed metal oxide precursor sol is coated on the glass tube. Next, passivation and fluorescent layers are simultaneously formed by baking the coated layers. Then, air is exhausted out of the glass tube and a discharge gas is injected into the glass tube. Finally, the glass tube is sealed.

18 Claims, 10 Drawing Sheets

FLUORESCENT LAMP AND MANUFACTURING METHOD THEREOF

CROSS REFERENCE TO RELATED APPLICATION

This application claims priority to and the benefit of Korean Application No. 10-2005-0129678 filed in the Korean Patent Office on Dec. 26, 2005, the entire content of which is incorporated herein by reference.

FIELD OF THE INVENTION

The present invention relates to a fluorescent lamp and a manufacturing method thereof, and more particularly, to a fluorescent lamp having a uniform passivation layer that can prevent or suppress a darkening phenomenon occurring when driving the fluorescent lamp and can increase a secondary electron emitting rate, thereby improving the lifetime and luminance of the fluorescent lamp, and a method of manufacturing the fluorescent lamp.

BACKGROUND OF THE INVENTION

Fluorescent lamps are classified into a cold cathode fluorescent lamp (CCFL) having electrodes disposed inside of a cylindrical glass tube and an external electrode fluorescent lamp (EEFL) having electrodes disposed outside of the glass tube.

The fluorescent lamp includes a phosphor layer formed by coating a fluorescent material on an inner wall of the glass tube, and a discharge gas including a certain content of gas and mercury for driving the light emission in the glass tube. Particularly, since the EEFL has electrodes disposed on an outer wall of the glass tube instead of the inner wall, and it can be easily manufactured in the form of a capillary tube type.

Generally, when high voltage is applied to the electrodes, electrons in the glass tube collide with neutral gas atoms while traveling toward one of the electrodes (cathode electrode), thereby generating ions. The generated ions travel to the other electrode (anode electrode) so that secondary electrons are emitted from the anode electrode. By the discharge, in the case of a mercury fluorescent lamp, ultraviolet rays having a wavelength of about 253.7 nm are emitted by the collision of the traveling electrons with mercury atoms. The ultraviolet rays excite the phosphor layer to emit visible light.

However, when the fluorescent lamp is used for a long time, a darkening phenomenon occurs by an amalgam generated from the reaction of mercury filled in the fluorescent lamp with an alkali component of a glass substrate, or by an impurity of the discharge gas released from impure trace residues of the fluorescent substance.

Various methods have been proposed to suppress the darkening phenomenon.

Korean Pat. Publication No. 2001-0074017 discloses an EEFL, in which a metal oxide such as MgO, or CaO is deposited on an inner surface of the glass tube in order to increase the lifetime of the fluorescent lamp and the secondary electron emission. However, the patent 2001-0074017 only estimates the effect of using the metal oxide and does not prove the effect. Furthermore, the patent does not disclose a composition of the metal oxide. Moreover, a method for forming the ferroelectric layer is not provided.

Korean Pat. Publication No. 1999-0083535 discloses a fluorescent lamp wherein a passivation layer is interposed between the glass tube and the phosphor layer in order to suppress the darkening phenomenon and to keep a high luminous flux maintenance factor. That is, a colloid suspension is formed by dispersing $\gamma$-$Al_2O_3$ in water and then the colloid suspension is coated on a glass tube. Thereafter, the glass tube is baked at 600° C. so that the passivation layer is formed.

According to the publication No. 1999-0083535, only the case where the passivation layer is formed on a glass substrate is disclosed, rather than a capillary glass tube for the fluorescent lamp. Therefore, it is difficult to apply the technology disclosed in the patent to produce an EEFL having the cylindrical glass tube having a relatively small diameter. Also, it is difficult to have a uniform passivation layer due to deterioration of colloid stability, which is caused by aggregation of the $\gamma$-$Al_2O_3$ particles.

Therefore, a dry coating method such as a deposition or a sputtering may be used in order to form a uniform passivation layer. However, when the glass tube is a capillary type, it is impossible to form the passivation layer on the capillary type glass tube for the fluorescent lamp.

SUMMARY OF THE INVENTION

The present invention provides a fluorescent lamp manufacturing method that can form a metal oxide passivation layer on a glass tube through a wet coating and baking processes using a sol including a metal oxide precursor prepared by sol-gel reaction.

The present invention provides a fluorescent lamp having a metal oxide passivation layer that can prevent or suppress a darkening phenomenon and increase a secondary electron emission rate, thereby improving the lifetime and luminance of the fluorescent lamp.

According to one exemplary embodiment of the present invention, there is provided a method of manufacturing a fluorescent lamp including: coating one of a dispersed metal oxide precursor sol prepared by a sol-gel reaction and a fluorescent substance slurry on a glass tube having at least one open side; coating the other of the fluorescent substance slurry and the dispersed metal oxide precursor sol on the glass tube; forming passivation and fluorescent layers simultaneously by baking the coated layers; exhausting air out of the glass tube; and injecting gas into the glass tube and sealing the glass tube.

The metal oxide precursor may be an alkoxide or a nitrate including metal selected from the group consisting of Mg, Ca, Sr, Ba, and a combination thereof.

According to another exemplary embodiment of the present invention, there is provided a fluorescent lamp manufactured by the foregoing method.

The fluorescent lamp may be one selected from the group consisting of a cold cathode fluorescent lamp (CCFL), an external electrode fluorescent lamp (EEFL), and a flat fluorescent lamp (FFL).

BRIEF DESCRIPTION OF THE DRAWING

A more complete appreciation of the invention, and many of the attendant advantages thereof, will be readily apparent as the same becomes better understood by reference to the following detailed description when considered in conjunction with the accompanying drawings.

DETAILED DESCRIPTION OF THE INVENTION

Figure 1:
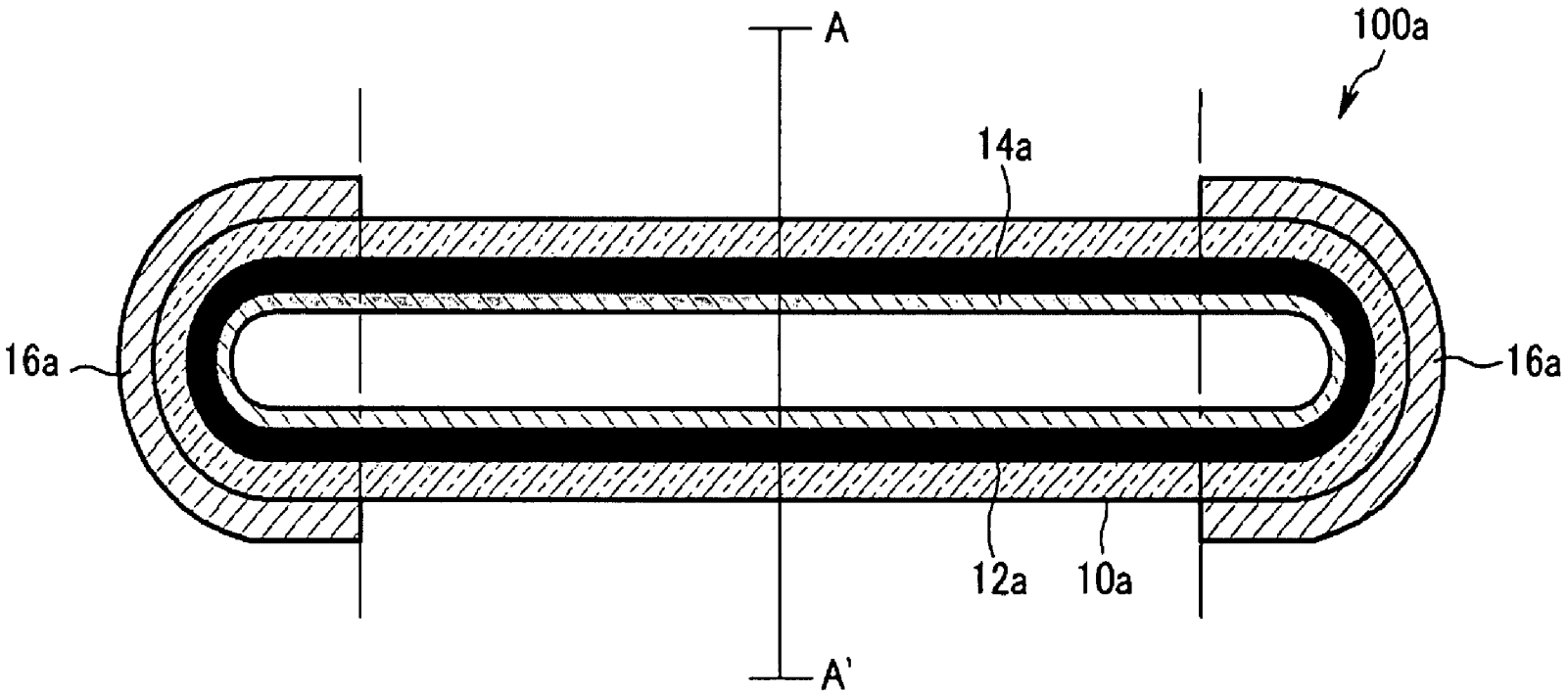
FIG. 1 is a side sectional view of an EEFL according to a first embodiment of the present invention.

The present invention will now be described more fully with reference to the accompanying drawings, in which exemplary embodiments of the invention are shown. The invention may, however, be embodied in many different forms and should not be construed as being limited to the embodiments set forth herein; rather these embodiments are provided so that this disclosure will be thorough and complete, and will fully convey the concept of the invention to those skilled in the art. Wherever possible, the same reference numbers will be used throughout the drawings to refer to the same or like parts.

A uniform passivation layer having good adhesive force can be easily applied on a glass tube of a fluorescent lamp using a metal oxide precursor sol prepared by a sol-gel reaction.

The metal oxide precursor sol prepared by the sol-gel reaction is a solution in which precursors that may be transformed to the metal oxide by baking are uniformly dispersed. The metal oxide precursor sol has good adhesive force to a variety of glass tubes and forms a transparent, uniform layer through a baking process. Particularly, it has been impossible to perform a coating on a tube-type glass substrate in the prior art. However, it becomes possible to perform a wet-coating on the tube-type glass member using the metal oxide precursor sol of the present invention using the capillary phenomenon.

The metal oxide precursor sol is prepared by a sol-gel reaction well known in the art. For example, the dispersed metal oxide precursor sol may be prepared by conducting hydrolysis and condensation after injecting a sol-gel precursor and a solvent into a reactor.

The sol-gel precursor is a compound forming the metal oxide precursor that may be formed of an alkoxide or a nitrate including alkali earth metal selected from the group consisting of Mg, Ca, Sr, Ba, and a combination thereof. The solvent may be selected from the group consisting of water, methanol, ethanol, isopropanol, n-propanol, n-butanol, sec-butanol, t-butanol, methyl celloslve, ethyl celloslve, butyl celloslve, ethyl acetate, methyl acetate, xyrene, toluene, and a combination thereof. Preferably, the solvent may be a mixture of water and a C1~C5 lower alcohol.

At this point, in order to catalyze the hydrolysis and reduce a baking temperature, an acid or a base may be added. The acid may be an acid catalyst such as acetic acid, phosphoric acid, sulfuric acid, hydrochloric acid, nitric acid, chlorosulfonic acid, p-toluene sulfonic acid, trichloroacetic acid, polyphosphoric acid, iodic acid, iodic acid anhydrate, or perchloric acid. The base may be a base catalyst such as sodium hydroxide, potassium hydroxide, n-butyl amine, di-n-butyl amine, imidazole, or ammonium perchlorate. Preferably, the acetic acid in the alcohol-based solvent may be used to prevent a liquid-liquid phase separation in the early stage of the hydrolysis and to control a concentration of the liquid member.

The concentration of the dispersed metal oxide precursor sol is within a range of 0.01-70%, preferably 0.05-50%, in order to be used in the wet-coating.

If necessary, the dispersed metal oxide precursor sol may include an additive such as a mercury abatement inhibitor or a dark property enhancer.

The mercury abatement inhibitor prevents deterioration of the glass tube, which is caused by accelerated ions and electrons generated by a high voltage, thereby preventing an increase of the consumption of mercury gas. The mercury abatement inhibitor is a metal oxide selected from the group consisting of $Y_2O_3$, $CeO_2$, $Al_2O_3$, and a combination thereof. The mercury abatement inhibitor may be 1.0~90 parts by weight per 100 parts by weight of a solid content of the metal oxide precursor including the alkali earth metal.

The dark property enhancer improving a dark property by conducting a rapid drive of the lamp in a dark status may be Cs or a Cs compound. The Cs compound may be a Cs oxide selected from the group consisting of $CsO_2$, $Cs_2O$, $Cs_2O_2$, $Cs_2SO_4$, $Cs(OH)_2$, and a combination thereof. The Cs oxide may be 1.0~90 parts by weight per 100 parts by weight of the solid content of the metal oxide precursor including the alkali earth metal.

Particularly, according to the present invention, the dispersed metal oxide precursor sol is wet-coated on the glass tube and the metal oxide passivation layer may be formed on the fluorescent lamp by baking the wet-coated dispersed metal oxide precursor.

The wet coating may be preformed by a typical method well-known in the art, such as a dip coating, a roll coating, a blade coating, a slit coating, or a spray coating. According to an embodiment of the present invention, the wet coating of the metal oxide precursor sol on the glass tube may be conducted by immersing the glass substrate in a container containing the sol. In this case, the sol is coated on the inner wall of the glass substrate by the capillary phenomenon. Also, the wet coating on a plate-type glass substrate may be conducted by dip coating or spray coating.

The baking process is conducted at a temperature lower than a temperature at which the glass substrate is deformed but higher than a temperature where all organic matters are oxidized by baking. Preferably, the baking process is conducted at a temperature within a range of 350-600° C.

Therefore, the passivation layer has a compact structure of the metal oxide such as MgO, CaO, SrO, or BaO. Also, the size of the metal oxide particles in the passivation layer is within a range of 0.001 μm-100 μm, preferably 0.01 μm -50 μm. The thickness of the passivation layer is preferably within a range of 0.1 μm -10 μm that is similar to a thickness of the fluorescent substance. The passivation layer may have a lifetime problem if it is too thin. Therefore, the passivation layer is formed within the above range using the metal oxide sol, if thicker than the above-described thickness range.

The passivation layer formed of the metal oxide precursor sol is introduced to the fluorescent lamp. The passivation layer exposed directly to the discharge area prevents the glass tube or the fluorescent substance from deteriorating by the ions and electrons accelerated by the high voltage when the fluorescent lamp is driven. Also, the passivation layer suppresses the increase of the mercury gas consumption.

Therefore, the introduction of the passivation layer to the fluorescent lamp enhances dramatically the lifetime and luminance of the fluorescent lamp.

In the present invention, the passivation layer may be formed on the fluorescent lamp of the present invention by the following method. The fluorescent lamp of the present invention may be manufactured by a method including: a first coating process for coating one of a dispersed metal oxide precursor sol prepared by the sol-gel process and a fluorescent substance slurry on the glass tube having at least one open side; a second coating process for coating the other of the dispersed metal oxide precursor sol and the fluorescent substance slurry; a process for forming the passivation and fluorescent layers simultaneously by baking the coating layers formed in the first and second coating processes; a process for exhausting air out of the glass tube; and a process for injecting gas and sealing the glass tube.

That is, when the dispersed metal oxide precursor sol is coated firstly on the glass tube in the first coating process, the fluorescent substance slurry may be coated secondly on the glass substrate in the second coating process. Similarly, when the fluorescent substance slurry is coated firstly on the glass tube in the first coating process, the dispersed metal oxide precursor sol may be coated secondly on the glass substrate in the second coating process.

At this point, the fluorescent lamp may be a CCFL, an EEFL, or an FFL, which may be manufactured by the above-described method.

The CCFL includes the glass tube having a discharge area inside thereof, a fluorescent layer formed on the inner wall of the glass tube, and a pair of internal electrodes formed on opposite inner ends of the glass tube.

The EEFL includes a glass tube having a discharge area inside thereof, a fluorescent layer formed on the inner wall of the glass tube, and a pair of external electrodes formed on opposite outer ends of the glass substrate.

The FFL includes a pair of glass substrates facing each other in parallel to form a glass tube, a discharge gas filled in the glass tube, a pair of external electrodes formed on opposite outer ends of the glass tube, and a fluorescent layer formed on one of the glass substrates.

At this point, the fluorescent lamp may employ the passivation layer in various shapes and locations. This will now be described in detail with reference to the accompanying drawings.

Figure 2:
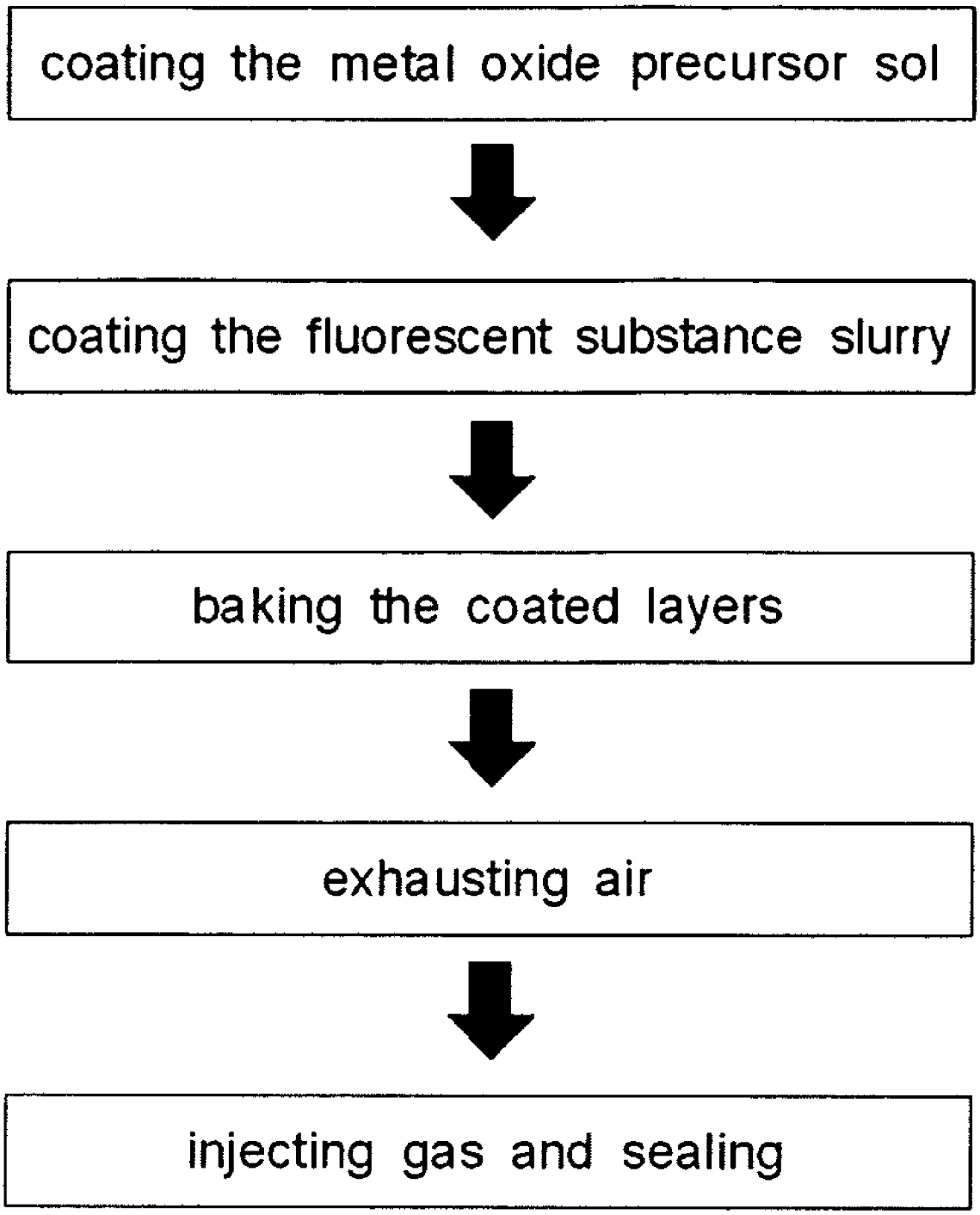
FIG. 2 is a flowchart illustrating a method of manufacturing the EEFL of FIG. 1.

FIG. 1 is a side sectional view of a fluorescent lamp according to a first embodiment of the present invention, and FIG. 2 is a flowchart illustrating a method of manufacturing the fluorescent lamp of FIG. 1. In this first embodiment, an EEFL is exampled as the fluorescent lamp.

Referring to FIG. 1, an EEFL 100*a* includes a glass tube 10*a* in which a discharge gas is injected, a pair of external electrodes 16*a* formed on opposite outer ends of the glass substrate 10*a*, and a fluorescent layer 14*a* coated on the inner wall of the glass tube 10*a*.

At this point, a passivation layer 12*a* is interposed between the glass tube 10*a* and the fluorescent layer 14*a*. The passivation and fluorescent layers 12*a* and 14*a* are formed on an entire surface of the inner wall of the glass tube 10*a*.

The passivation layer 12*a* may be formed of the metal oxide precursor sol prepared by the sol-gel reaction. The metal oxide may be an alkali earth metal-based oxide such as MgO, CaO, SrO, BaO, or a combination thereof.

The glass tube 10*a* may be a transparent tube formed of a soft glass such as soda lime glass or lead glass, a hard glass such as borosilicate glass, or a semi-hard glass. The glass tube 10*a* may be a bulb-type, a straight tube-type, a flat tube-type, or the like.

The discharge gas injected into the glass tube 10*a* may be a mixture of mercury and a gas such as Ar or Ne.

The external electrodes 16*a* may be formed of a metal that generates an electric field when an electric current is applied thereto in order for the EEFL 100*a* to emit light. However, the material of the external electrodes 16*a* is not limited to this case. Any conventional materials for the electrodes may be used. Preferably, the external electrodes 16*a* may be formed of an electrically conductive material having a relatively low resistivity.

At this point, the external electrodes 16*a* fully wrap the respective opposite outer ends of the glass tube 10*a*. The external electrodes 16*a* each may be provided in the formed of a metal cap or a metal tape. Alternatively, the external electrodes 16*a* may be formed by dipping the opposite outer ends of the glass tube 10*a* into a metal solution. However, the present invention is not limited to these cases.

The fluorescent layer 14*a* is formed of a fluorescent substance used for typical fluorescent lamps, but is not specifically limited. The thickness of the fluorescent layer 14*a* is within a range of 1.0~20 μm, more preferably 5.0~10 μm.

The EEFL 100*a* may emit light by applying a continuous alternative voltage or a pulse voltage to the external electrodes 16*a*. That is, the electric discharge occurs inside the glass tube 10*a* due to the electric field generated by applying a high frequency voltage to the external electrodes 16*a*. The electric discharge generates ultraviolet rays and the fluorescent layer 14*a* coated on the inner wall of the glass tube 10*a* is excited by the ultraviolet rays to emit visible light.

In the EEFL 100*a* according to the embodiment of FIG. 1, the passivation layer 12*a* prevents an alkali component of the glass substrate 10*a* and an impure residue of the fluorescent substance from moving to the discharge region. Therefore, a darkening phenomenon is suppressed or prevented and thus an emission of secondary electrons increases, thereby enhancing the lifetime and luminance of the EEFL 100*a*.

Referring FIG. 2, the dispersed metal oxide precursor is wet-coated on an entire surface of the inner wall of the glass tube of the EEFL (the first coating process), according to the first embodiment of the present invention. Then, the fluorescent substance slurry is wet-coated on an entire surface of the dispersed metal oxide precursor, and passivation and fluorescent layers are formed simultaneously by baking the coated layers. Thereafter, the processes for exhausting the air from the inside of the glass tube, injecting the discharge gas, and sealing the glass tube are conducted, thereby completing the fluorescent lamp.

The coating of the dispersed metal oxide precursor and the fluorescent slurry may be conducted through dip coating, blade coating, slit coating, or spray coating.

Figure 3:
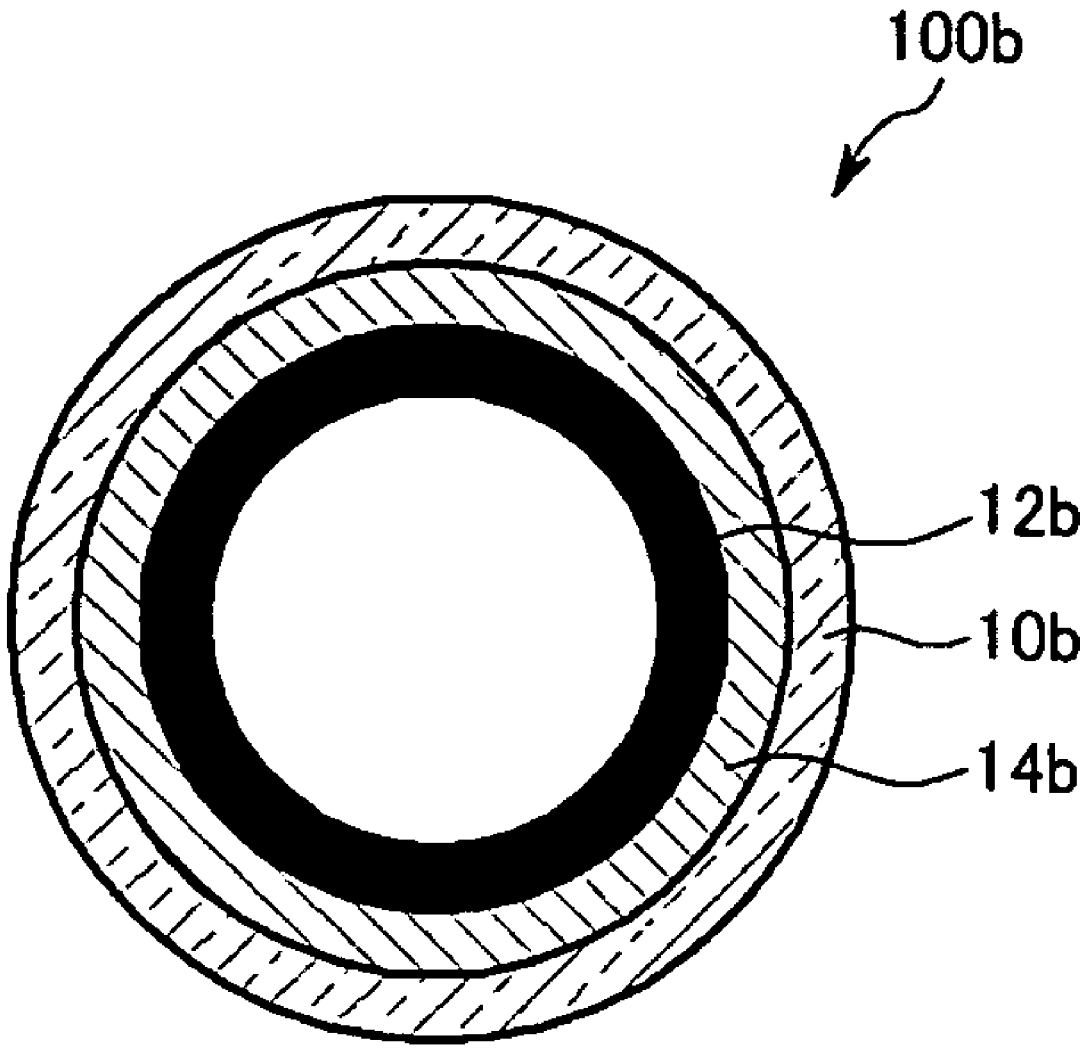
FIG. 3 is a cross-sectional view of an EEFL according to a second embodiment of the present invention.
Figure 4:
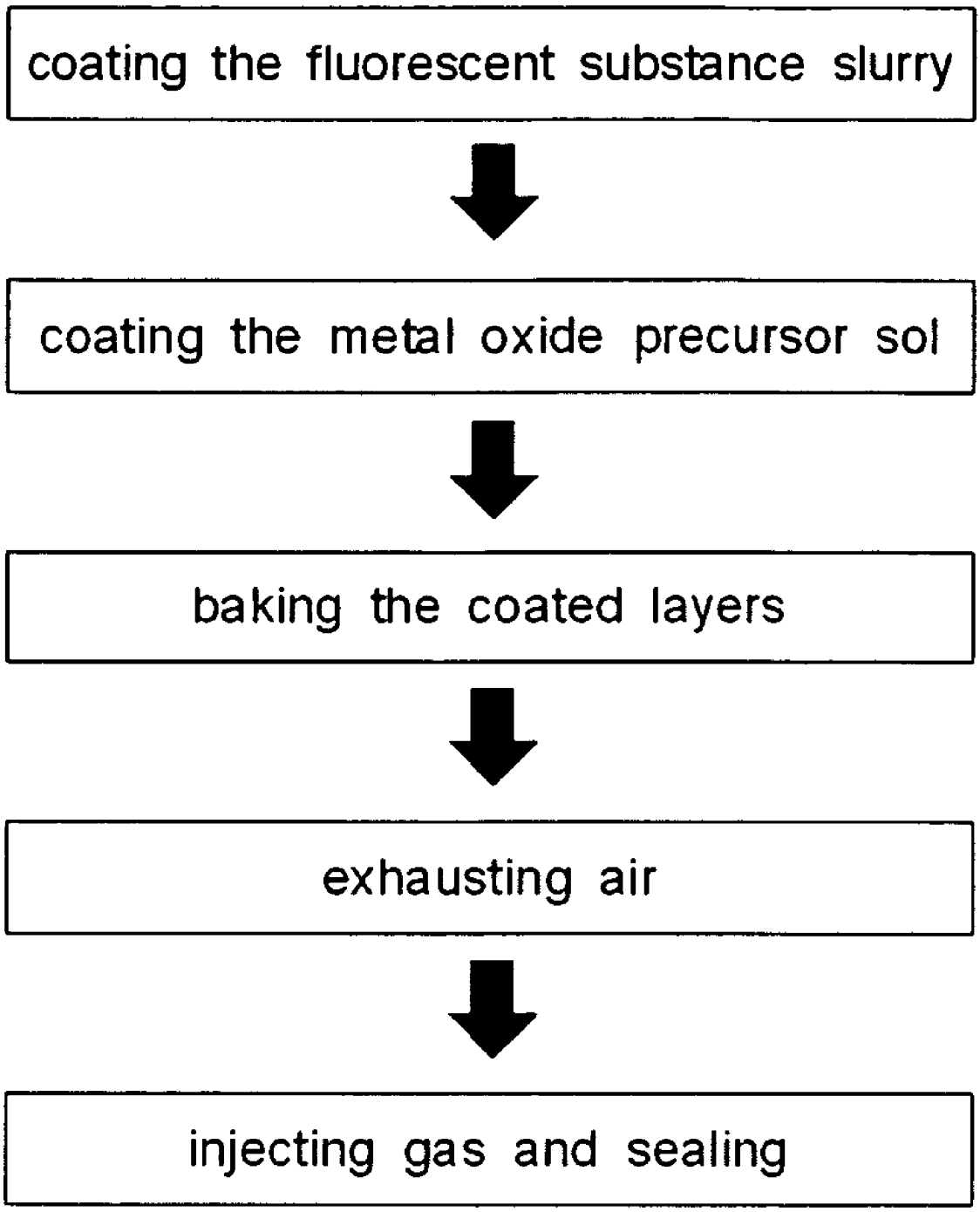
FIG. 4 is a flowchart illustrating a method of manufacturing the EEFL of FIG. 3.

FIG. 3 is a cross-sectional view of a fluorescent lamp according to a second embodiment of the present invention, and FIG. 4 is a flowchart illustrating a method of manufacturing the fluorescent lamp of FIG. 3. In this embodiment, an EEFL is exampled as the fluorescent lamp.

Referring to FIG. 3, a fluorescent layer 14*b* is formed on an inner wall of a glass tube 10*b* of an EEFL 100*b*, and a passivation layer 12*b* is formed on the fluorescent layer 14*b*. At this point, the passivation layer 12*b* is formed on an entire surface of the inner wall of the glass tube 10*b*.

Since other components of the EEFL of this embodiment are identical to those of the fluorescent lamp of FIG. 1, the detailed description thereof will be omitted herein.

Referring to FIG. 4, a fluorescent slurry is coated on an entire surface of the inner wall of the glass tube of the EEFL (the first coating process), and then a metal oxide sol is coated on an entire surface of the coated fluorescent slurry (the second coating process). Thereafter, the passivation and fluorescent layers are formed simultaneously by baking the coated layers. Then, the processes for exhausting air from the inside of the glass substrate, injecting the discharge gas, and sealing the glass tube are conducted, thereby completing the EEFL.

Figure 5:
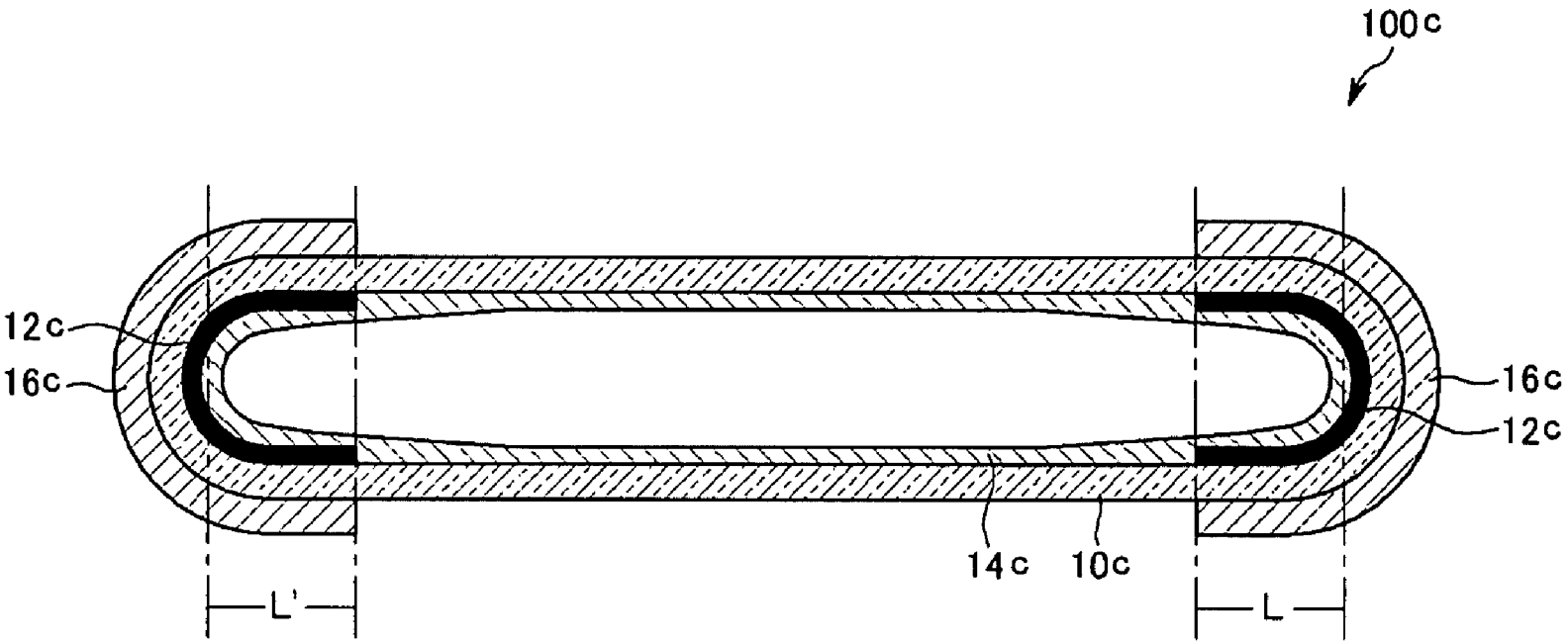
FIG. 5 is a side sectional view of an EEFL according to a third embodiment of the present invention.
Figure 6:
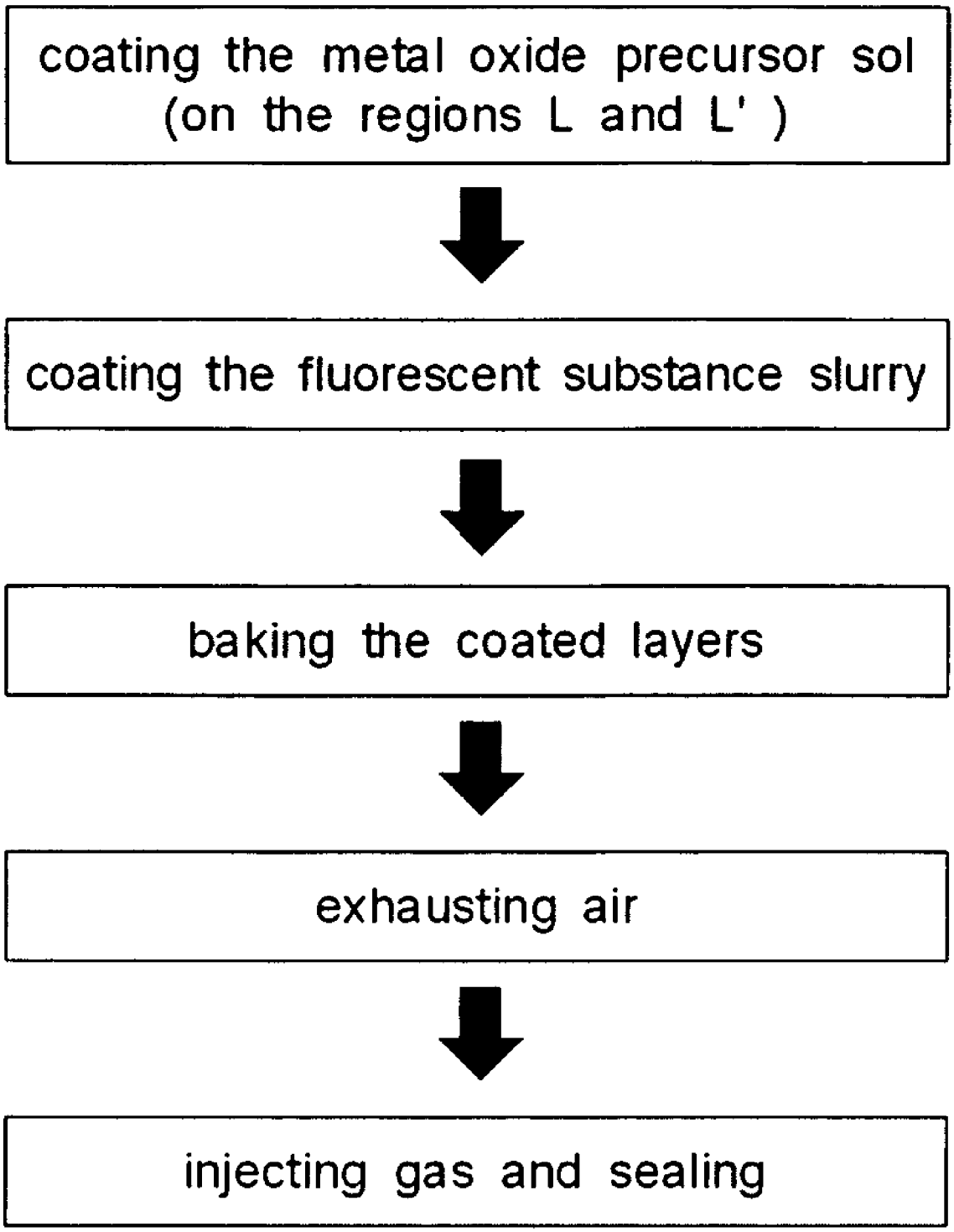
FIG. 6 is a flowchart illustrating a method of manufacturing the EEFL of FIG. 5.

FIG. 5 is a side sectional view of a fluorescent lamp according to a third embodiment of the present invention, and FIG. 6 is a flowchart illustrating a method of manufacturing the fluorescent lamp of FIG. 5.

Referring to FIG. 5, an EEFL 100*c* of this third embodiment includes a passivation layer 12*c* on regions L and L' of an inner wall of a glass tube 10*c*, which correspond to external electrodes 16*c*, and a fluorescent layer 14*c* is formed on an entire surface of the inner wall of the glass tube 10*c* covering the passivation layer 12*c*.

Since other components of the EEFL of this embodiment are identical to those of the fluorescent lamp of FIG. 1, the detailed description thereof will be omitted herein.

Referring to FIG. 6, in order to manufacture the EEFL of this embodiment, a metal oxide sol is coated on the regions L and L' (the first coating process), and a fluorescent slurry is coated on the entire surface of the inner wall of the glass tube to cover the metal oxide sol coated on the regions L and L1 (the second coating process). Then, the passivation and fluorescent layers are formed through the baking process. At this point, the coating of the metal oxide sol may be conducted by immersing both ends of the glass tube in a container containing the metal oxide sol so that the metal oxide sol is coated to a certain height by the capillary phenomenon. Thereafter, the processes for exhausting air from the inside of the glass substrate, injecting the discharge gas, and sealing the glass tube are conducted, thereby completing the fluorescent lamp.

Figure 7:
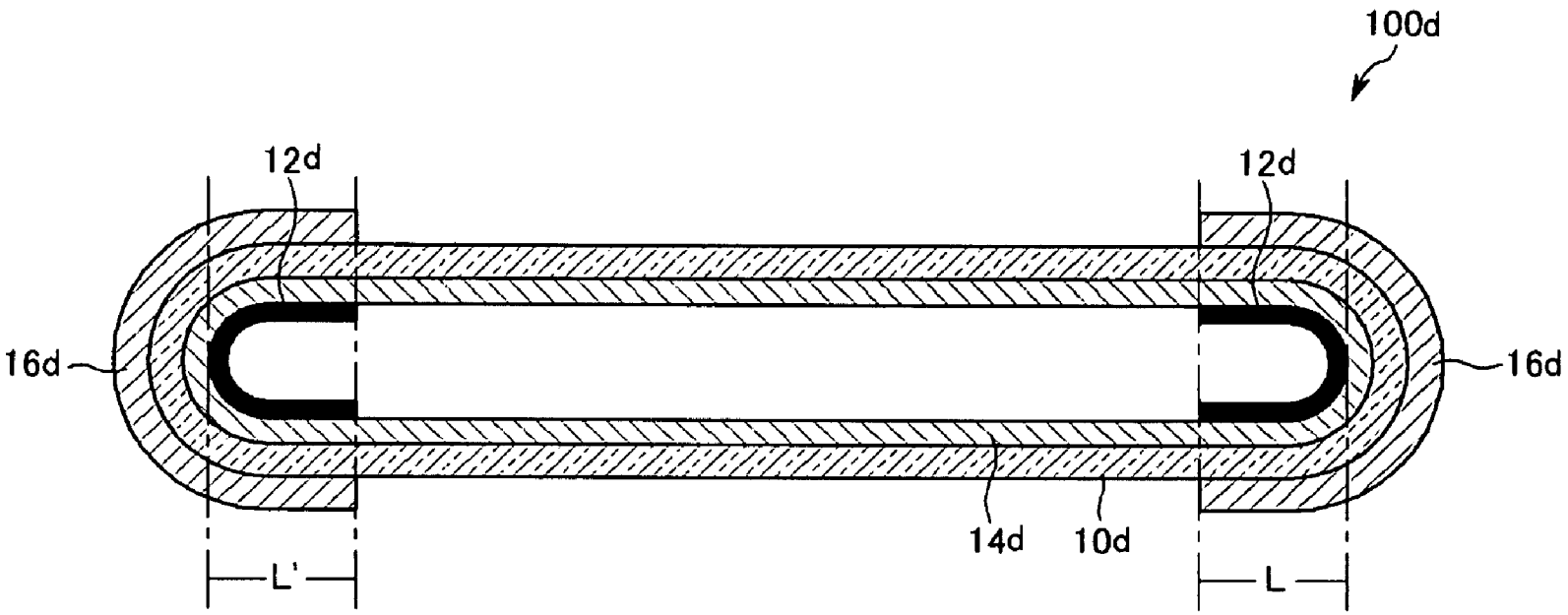
FIG. 7 is a side sectional view of an EEFL according to a fourth embodiment of the present invention.

FIG. 7 is a side sectional view of an EEFL according to a fourth embodiment of the present invention.

Referring to FIG. 7, unlike the EEFL 10*c* of FIG. 3, in an EEFL 100*d* of this fourth embodiment of the present invention, a fluorescent layer 14*d* is formed on an entire surface of an inner wall of a glass tube 10*d*, and a passivation layer 12*d* is formed on regions L and L' of the fluorescent layer 14*d*, which correspond to lengths of external electrodes 16*d*.

Since other components of the EEFL of this embodiment are identical to those of the fluorescent lamp of FIG. 1, the detailed description thereof will be omitted herein.

Figure 8:
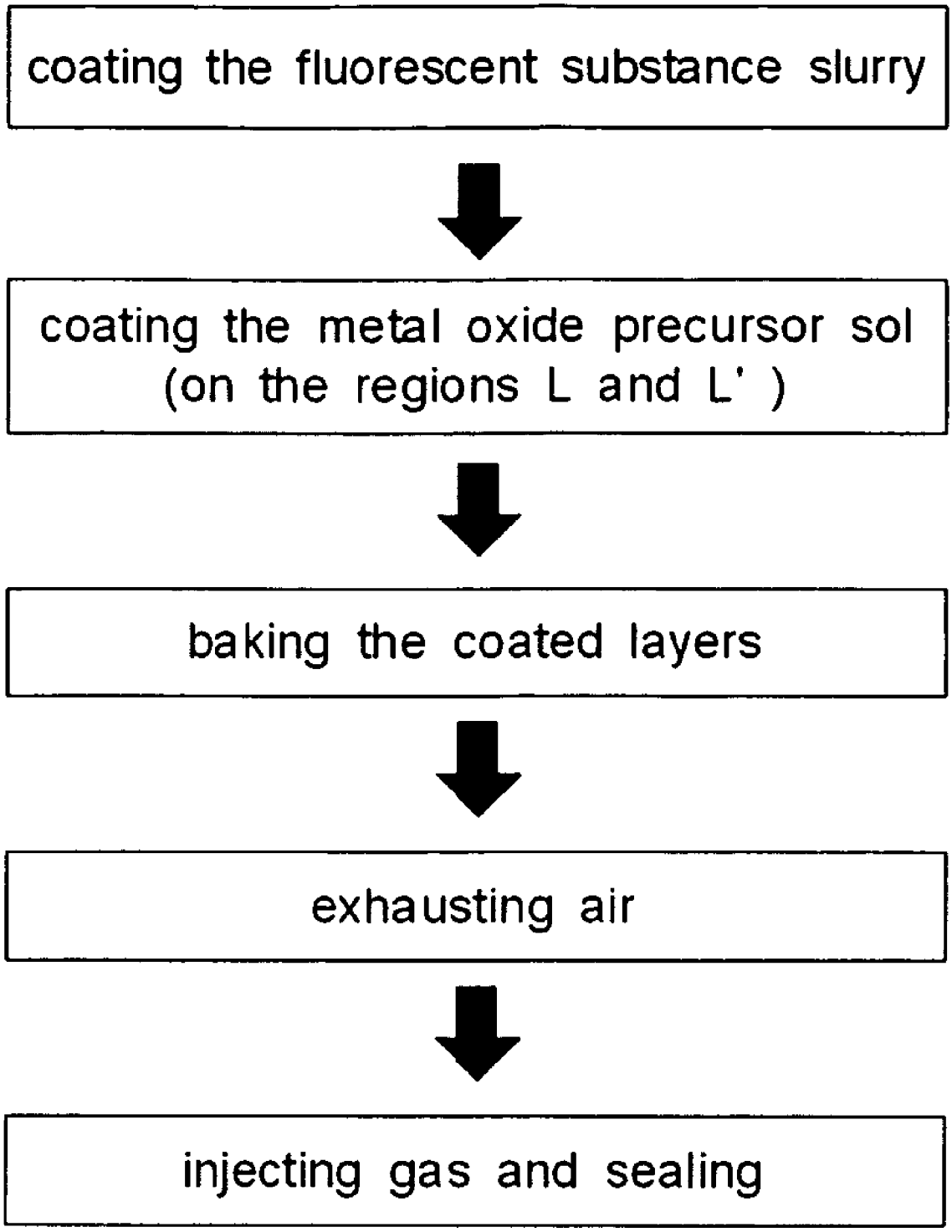
FIG. 8 is a flowchart illustrating a method of manufacturing the EEFL of FIG. 7.

Referring to FIG. 8, in order to manufacture the fluorescent lamp of this embodiment, a fluorescent slurry is first coated on the entire surface of the inner wall of the glass tube (the first coating process). Then, a metal oxide sol is coated on the regions L and L' of the fluorescent slurry coated on the entire surface of the inner wall of the glass tube (the second coating process). Then, the fluorescent and passivation layers are formed by baking the coated layers. Thereafter, processes for exhausting the air from the inside of the glass tube, injecting the discharge gas, and sealing the glass tube are conducted, thereby completing the fluorescent lamp.

Figure 9:
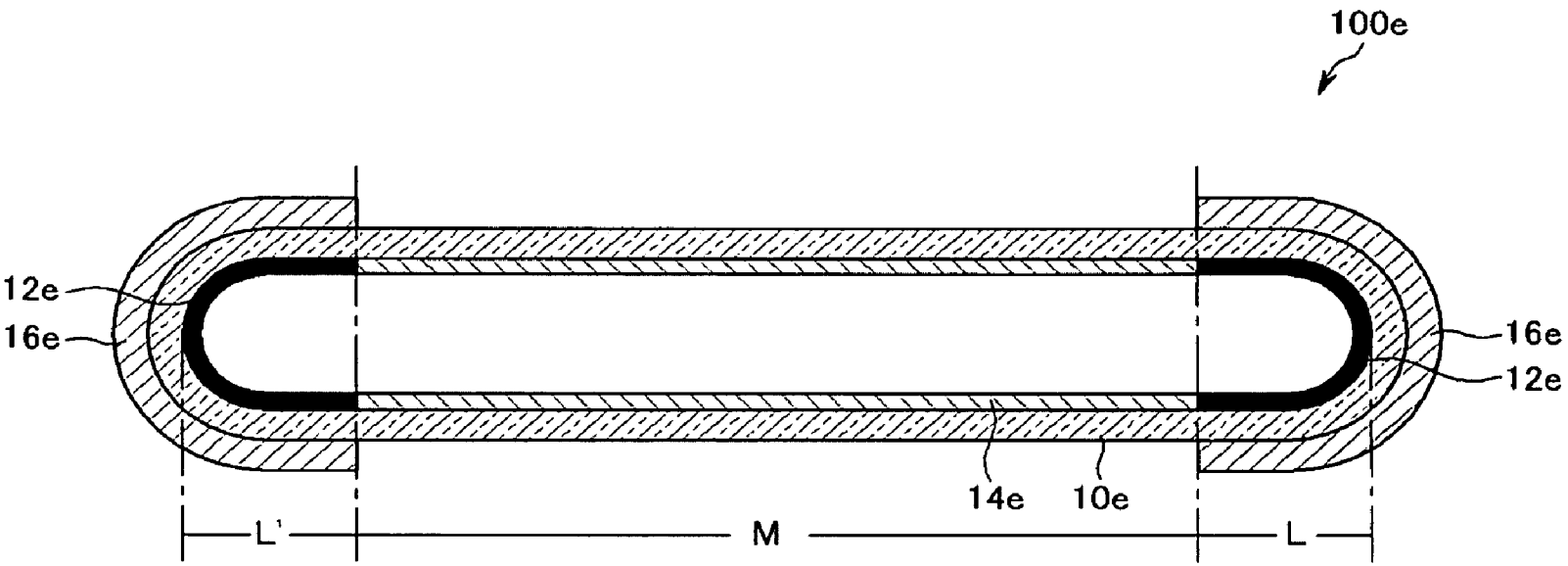
FIG. 9 is a side sectional view of an EEFL according to a fifth embodiment of the present invention.

FIG. 9 is a side sectional view of an EEFL according to a fifth embodiment of the present invention.

Referring to FIG. 9, in an EEFL 100*e* of this fifth embodiment, a passivation layer 12*e* is formed on regions L and L' of an inner wall of a glass tube 10*e*, which correspond to external electrodes 16*e*, and a fluorescent layer 14*e* is coated on a region M of the inner wall of the glass tube 10*e* except for the regions L and L'.

Since other components of the EEFL of this embodiment are identical to those of the fluorescent lamp of FIG. 1, the detailed description thereof will be omitted herein.

In the EEFLs 100*b*, 100*c*, 100*d*, and 100*e* of the respective second through fifth embodiments of the present invention, the passivation layers 12*b*, 12*c*, 12*d*, and 12*e* prevent or suppress the darkening phenomenon, thereby improving the lifetime and the luminance of the EEFLs 100*b*, 100*c*, 100*d*, and 100*e*.

Figure 10:
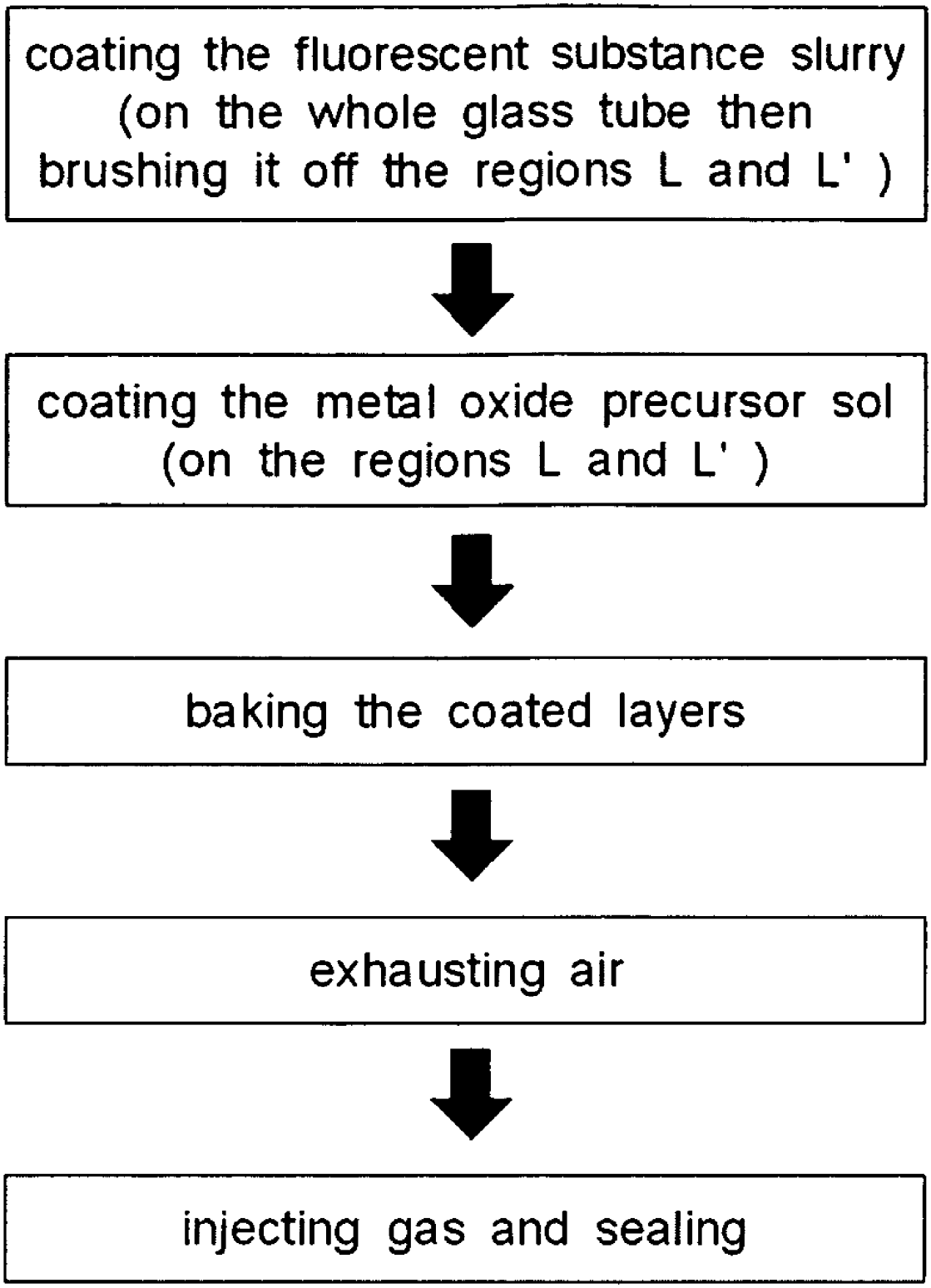
FIG. 10 is a flowchart illustrating a method of manufacturing the EEFL of FIG. 9.

Referring to FIG. 10, in order to manufacture the EEFL of the fifth embodiment, a fluorescent slurry is first coated (the first coating process), and then the metal oxide sol is coated on the regions L and L' (the second coating process) after portions of the fluorescent layer that correspond to the regions L and L' are removed by brushing. Then, the fluorescent and passivation layers are formed by baking the coated layers. Thereafter, processes for exhausting the air from the inside of the glass tube, injecting the discharge gas, and sealing the glass tube are conducted, thereby completing the fluorescent lamp.

According to the present invention, the metal oxide passivation layer formed on the inner wall of the glass tube prevents or suppresses the darkening phenomenon caused when a fluorescent lamp is used for a long time. That is, the passivation layer may improve the lifetime and luminance of the EEFL. The fluorescent lamp may be used as a backlight unit of, for example, a liquid crystal display (LCD), a lighting lamp, or a light source of a signboard. In this case, the lifetime and reliability of the devices where the fluorescent lamp of the present invention is applied can be improved.

While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. A method of manufacturing a fluorescent lamp, comprising:

coating one of a dispersed metal oxide precursor sol prepared by a sol-gel reaction and a fluorescent substance slurry on a glass tube having at least one open side;

coating the other of the fluorescent substance slurry and the dispersed metal oxide precursor sol on the glass tube;

forming passivation and fluorescent layers simultaneously by baking the coated layers;

exhausting air out of the glass tube; and injecting gas into the glass tube and sealing the glass tube;

wherein the passivation layer comprises a metal oxide selected from the group consisting of MgO, CaO, SrO, BaO, a combination thereof.

2. The method of claim 1, wherein the metal oxide precursor is an alkoxide or a nitrate including metal selected from the group consisting of Mg, Ca, Sr, Ba, and a combination thereof.

3. The method of claim 1, wherein a concentration of the dispersed metal oxide precursor sol is within a range of 0.1-70%.

4. The method of claim 1, wherein the coating of the two layers is conducted through a process selected from the group consisting of dip coating, roll coating, blade coating, slit coating, and spray coating processes.

5. The method of claim 1, wherein the baking of the coated layers is conducted at a temperature within a range of 350-600° C.

6. The method of claim 1, wherein the dispersed metal oxide precursor sol is deposited on an entire surface of an inner wall of the glass tube, or on regions of the inner wall of the glass tube that correspond to a length of the electrodes.

7. The method of claim 1, wherein the dispersed metal oxide precursor sol comprises an additive selected from the group consisting of a mercury abatement inhibitor, a dark property enhancer, and a combination thereof.

8. The method of claim 7, wherein the mercury abatement inhibitor is a metal oxide selected from the group consisting of $Y_2O_3$, $CeO_2$, $Al_2O_3$, and a combination thereof.

9. The method of claim 7, wherein the dark property enhancer is Cs or a compound selected from the group consisting of $CsO_2$, $Cs_2O$, $Cs_2O_2$, $Cs_2SO_4$, $Cs(OH)_2$, and a combination thereof.

10. The method of claim 7, wherein, in the metal oxide precursor sol, the additive is 1.0-90 parts by weight per 100 parts by weight of solid content.

11. The method of claim 1, wherein the passivation layer is disposed between the fluorescent layer and the glass tube, on the fluorescent layer formed on the glass tube, or on regions of the glass tube that correspond to the electrode.

12. The method of claim 1, wherein a particle size of the metal oxide in the passivation layer is within a range of 0.001-100 μm.

13. The method of claim 1, wherein a thickness of the passivation layer is with in a range of 0.1-10 μm.

14. The method of claim 1, wherein the fluorescent lamp is one selected from the group consisting of a cold cathode fluorescent lamp (CCFL), an external electrode fluorescent lamp (EEFL), and a flat fluorescent lamp (FFL).

15. The method of claim 1, further comprising preparing the dispersed metal oxide precursor sol with a sol-gel reaction.

16. The method of claim 1, wherein the metal oxide precursor is an alkoxide or a nitrate including metal.

17. A method of manufacturing a fluorescent lamp, comprising:

a step of preparing a dispersed metal oxide precursor sol with sol-gel reaction;

two steps of coating on a glass tube having at least one open side wherein the one step of coating is performed with a dispersed metal oxide precursor sol, and the other step of coating is performed with a fluorescent substance;

a step of forming passivation and fluorescent layers simultaneously by baking the coated layers;

a step of exhausting air out of the glass tube; and a step of injecting gas into the glass tube and sealing the glass tube, wherein the metal oxide precursor is an alkoxide or a nitrate including metal;

wherein the nitrate including metal is a nitrate including metal selected from the group consisting of Mg, Ca, Sr, Ba, and a combination thereof.

18. A method of manufacturing a fluorescent lamp, comprising:

coating one of a dispersed metal oxide precursor sol prepared by a sol-gel reaction and a fluorescent substance slurry on a glass tube having at least one open side;

coating the other of the fluorescent substance slurry and the dispersed metal oxide precursor sol on the glass tube;

forming passivation and fluorescent layers simultaneously by baking the coated layers;

exhausting air out of the glass tube; and injecting gas into the glass tube and sealing the glass tube;

wherein the metal oxide precursor is an alkoxide or a nitrate including metal selected from the group consisting of Mg, Ca, Sr, Ba, and a combination thereof; and wherein a concentration of the dispersed metal oxide precursor sol is within a range of 0.1-70%.

* * * * *